US010435838B2

(12) United States Patent
Masaki et al.

(10) Patent No.: US 10,435,838 B2
(45) Date of Patent: Oct. 8, 2019

(54) DYED ARTIFICIAL LEATHER AND A PRODUCTION METHOD THEREFOR

(71) Applicant: TORAY INDUSTRIES, INC., Tokyo (JP)

(72) Inventors: Masaru Masaki, Osaka (JP); Katsuya Okajima, Osaka (JP); Tomoharu Hirose, Osaka (JP); Ai Suzuki, Otsu (JP); Satoshi Yanagisawa, Gifu (JP)

(73) Assignee: Toray Industries, Inc. (JP)

( * ) Notice: Subject to any disclaimer, the term of this patent is extended or adjusted under 35 U.S.C. 154(b) by 163 days.

(21) Appl. No.: 15/301,154

(22) PCT Filed: Mar. 20, 2015

(86) PCT No.: PCT/JP2015/058527
§ 371 (c)(1),
(2) Date: Sep. 30, 2016

(87) PCT Pub. No.: WO2015/151873
PCT Pub. Date: Oct. 8, 2015

(65) Prior Publication Data

US 2017/0022659 A1 Jan. 26, 2017

(30) Foreign Application Priority Data

Mar. 31, 2014 (JP) ..... 2014-072602
Aug. 27, 2014 (JP) ..... 2014-172484

(51) Int. Cl.
*D06N 3/00* (2006.01)
*D06N 3/14* (2006.01)
*D06P 1/00* (2006.01)

(52) U.S. Cl.
CPC ..... *D06N 3/0004* (2013.01); *D06N 3/0011* (2013.01); *D06N 3/0034* (2013.01); *D06N 3/0036* (2013.01); *D06N 3/14* (2013.01); *D06P 1/002* (2013.01); *D06N 2211/28* (2013.01)

(58) Field of Classification Search
CPC ..... D06N 3/0004; D06N 3/14; D06N 3/0034; D06N 3/0036; D06N 3/0011; D06N 2211/28; D06P 1/002
USPC ..... 8/485, 501, 902
See application file for complete search history.

(56) References Cited

U.S. PATENT DOCUMENTS 4,983,185 A * 1/1991 Streicher ..... D06P 1/44 8/404
5,503,899 A 4/1996 Ashida et al.
2004/0063366 A1* 4/2004 Nakayama ..... D06N 3/0004 442/104

FOREIGN PATENT DOCUMENTS

| | | | | |
|---|---|---|---|---|
| CN | 101798736 A | | 8/2010 | |
| EP | 1403421 A2 | | 3/2004 | |
| JP | 5921991 | | 5/1984 | |
| JP | 609966 | | 1/1985 | |
| JP | 06146177 | | 5/1994 | |
| JP | H07173778 A | | 7/1995 | |
| JP | 3109793 B2 | | 11/2000 | |
| JP | 2004263316 | | 9/2004 | |
| JP | 3789353 | | 6/2006 | |
| JP | 2006152461 A | | 6/2006 | |
| JP | 2008196080 | | 8/2008 | |
| JP | 4805184 | | 11/2011 | |
| KR | 20140003818 A | * | 1/2014 | ..... D06M 11/38 |

OTHER PUBLICATIONS

English translation to KR 20140003818 A to Suc et al. (Jan. 2014) obtained from European Patent Office website. (Year: 2014).*
International Search Report and Written Opinion for International Application No. PCT/JP2015/058527, dated Jun. 16, 2015, 4 pages.
International Preliminary Report on Patentability dated Oct. 4, 2016 for International Application No. PCT/JP2015/058527, 12 pages.
Extended European Search Report for European Application No. 15774303.0, dated Nov. 3, 2017, 7 pages.
Chinese Office Action for Chinese Application No. 201580016533.1, dated Jun. 29, 2017 with translation, 12 pages.
Notification of Reasons for Refusal for Japanese Application No. 2015-518495, dated Dec. 20, 2018, with translation, 7 pages.
Taiwanese Office Action for Taiwanese Application No. 104108608, dated Nov. 28, 2018, with partial translation, 18 pages.

* cited by examiner

*Primary Examiner* — Jeremy R Pierce
(74) *Attorney, Agent, or Firm* — RatnerPrestia

(57) ABSTRACT

A dyed artificial leather includes a fibrous base containing ultrafine fibers with a filament fineness of 2 decitex or less and a polymeric elastomer, and characterized in that the lightness difference ΔL* between the ultrafine fibers and the polymeric elastomer represented by the following equation meet the requirement of $-16 \leq \Delta L^* \leq 5$: ΔL*=(average lightness L* of ultrafine fibers)−(average lightness L* of polymeric elastomer). A production method for dyed artificial leather includes a first dying step in which artificial leather constituted mainly of a fibrous base containing ultrafine fibers with a filament fineness of 2 decitex or less and a polymeric elastomer is dyed using a dye and a subsequent second dyeing step performed at a dye concentration that is 0.1% to 30% of the dye concentration (owf) in the first dyeing step.

5 Claims, No Drawings

DYED ARTIFICIAL LEATHER AND A PRODUCTION METHOD THEREFOR

CROSS-REFERENCE TO RELATED APPLICATIONS

This is the U.S. National Phase application of PCT/JP2015/058527, filed Mar. 20, 2015, and claims priority to Japanese Patent Application No. 2014-072602, filed Mar. 31, 2014, and Japanese Patent Application No. 2014-172484, filed Aug. 27, 2014, the disclosures of each of these applications being incorporated herein by reference in their entireties for all purposes.

FIELD OF THE INVENTION

The present invention relates to dyed artificial leather composed of a fibrous base containing ultrafine fibers and a polymeric elastomer and also relates to a production method therefor.

BACKGROUND OF THE INVENTION

Owing to their soft feel and texture as well as high quality appearance, suede-like artificial leather products composed of ultrafine fibers and a polymeric elastomer have been used in a wide variety of applications including garments, furniture, and automobile interior materials. In recent years, there are increased demands for products of higher surface quality, particular for those having improved color unevenness owing to the use of ultrafine fibers and a polymeric elastomer of an identical color and maintaining high color fastness.

A generally used method for dyeing artificial leather is to dye artificial leather at a temperature at which ultrafine fibers are dyed most effectively in a dying machine, followed by washing or fixation treatment. This dying method, however, has the problem of inability to achieve effective coloring of polymeric elastomers, though being able to color ultrafine fibers effectively.

To solve this problem, there has been a proposal of an improvement in the conventional artificial leather method. Specifically, the dying method first dye artificial leather using a disperse dye in a dying machine and then perform treatment for reduction cleaning to produce artificial leather with high color developing ability, levelness of dyeing, and dyed color fastness (see Patent document 1).

In another proposal, artificial leather produced by forming a nap of polyester ultrafine fibers on one or both sides of an artificial leather base composed of a polyester fiber nonwoven fabric and an elastic polymer is first dyed with a disperse dye, then treated with a reduction agent to reduce and decompose the excess disperse dye, thereby decolorizing the elastic polymer parts exposed in the surface of the artificial leather base, subjected to oxidation cleaning with an oxidizing agent as required, and treated with hot water containing a surface active agent so that the dye contained in the elastic polymer in the artificial leather base moves to the surface of the elastic polymer (see Patent document 2).

PATENT DOCUMENTS

[Patent document 1] Japanese Patent No. 4805184
[Patent document 2] Japanese Patent No. 3789353

SUMMARY OF THE INVENTION

All of these proposals, however, have the problem of color unevenness between ultrafine fibers and the polymeric elastomer, particularly in the case of dyeing in a light to medium color, because of an insufficient quantity of the dye that can remain after the reduction cleaning step, leading to insufficient coloring of the polymeric elastomer. In any of these proposals, furthermore, there is no proposal about the dyeing of the polymeric elastomer contained in artificial leather.

Thus, an object of the present invention is to provide dyed artificial leather including ultrafine fibers and a polymeric elastomer, having no color unevenness between the ultrafine fibers and the polymeric elastomer, and having good surface quality high in washing fastness, rubbing fastness, and light fastness.

The present invention aims to solve these problems, and the dyed artificial leather according to an aspect of the present invention is produced by dyeing artificial leather constituted mainly of a fibrous base containing ultrafine fibers with a filament fineness of 2 decitex or less and a polymeric elastomer and characterized in that the lightness difference $\Delta L^*$ between the ultrafine fibers and the polymeric elastomer represented by the following equation meet the requirement of $-16 \leq \Delta L^* \leq 5$:

$$\Delta L^* = (\text{average lightness } L^* \text{ of ultrafine fibers}) - (\text{average lightness } L^* \text{ of a polymeric elastomer}).$$

According to a preferred embodiment of the artificial leather according to the present invention, the polymeric elastomer contains polyurethane.

The production method for dyed artificial leather according to an aspect of the present invention is characterized by including a first dying step in which artificial leather constituted mainly of a fibrous base containing ultrafine fibers with a filament fineness of 2 decitex or less and a polymeric elastomer is dyed using a dye and a subsequent second dyeing step performed at a dye concentration that is 0.1% to 30% of the dye concentration (owf) in the first dyeing step.

In a preferable embodiment of the production method for dyed artificial leather according to the present invention, the dyeing temperature in the second dyeing step is lower than that in the first dyeing step.

In a preferable embodiment of the production method for dyed artificial leather according to the present invention, the polymeric elastomer contains polyurethane.

In a preferable embodiment of the production method for dyed artificial leather according to the present invention, the ultrafine fibers are of a fiber material selected from the group consisting of polyester based fiber materials and polyamide based fiber materials.

In a preferable embodiment of the production method for dyed artificial leather according to the present invention, the dyeing temperature in the first dying step is in the range of 90° C. to 140° C.

In a preferable embodiment of the production method for dyed artificial leather according to the present invention, the dyeing temperature in the second dying step is in the range of 60° C. to 90° C.

In a preferable embodiment of the production method for dyed artificial leather according to the present invention, the dye to be add in the second dying step is one selected from the group consisting of disperse dyes, cationic dyes, acidic dyes, and styrene based dyes.

In a preferable embodiment of the production method for dyed artificial leather according to the present invention, the washing fixation treatment performed after the first dying step and the second dyeing step is realized by one selected from the group consisting of hot water rinsing treatment, reduction cleaning treatment, and dye fixation treatment.

According to the present invention, dyed artificial leather free of color unevenness between the ultrafine fibers and the polymeric elastomer and high in dyed color fastness can be obtained in the light to medium color range as well as in the dark color range.

In the conventional artificial leather products the color difference between the ultrafine fibers and the polymeric elastomer can be clearly detected by visual observation, but the present invention can provide products having good surface quality with little color difference. In particular, dyed artificial leather products dyed in red tend to suffer from a significant color difference between the ultrafine fibers and the polymeric elastomer, compared to products of other colors, but the present invention has made it possible to produce dyed artificial leather with a high commercial value that has good surface quality and high dyed color fastness.

DETAILED DESCRIPTION OF EMBODIMENTS OF THE INVENTION

Embodiments of the dyed artificial leather and the production method therefor according to the present invention are described in detail below.

The dyed artificial leather according to the present invention provides dyed artificial leather including a fibrous base containing ultrafine fibers and a polymeric elastomer.

The usable materials for the ultrafine fibers include various synthetic fiber materials formed of polymers including polyester based fibers such as polyethylene terephthalate, polybutylene terephthalate, polytrimethylene terephthalate, and polyethylene 2,6-naphthalene dicarboxylate, and polyamide based fibers such as 6-nylon, 66-nylon, 610-nylon, 11-nylon, 12-nylon, 26-nylon, 76-nylon, 210-nylon, and 410-nylon. In particular, polyester fibers formed of polymers such as polyethylene terephthalate, polybutylene terephthalate, and polytrimethylene terephthalate are particularly preferred from the viewpoint of high strength, dimensional stability, light resistance, and dyeing properties.

In addition, the polymer forming the island component may contain inorganic particles such as particles of titanium oxide, lubricant, pigment, heat stabilizer, UV absorber, electroconductive agent, heat storage agent, or antibiotic, which may be added depending on the intended application.

As for the cross-sectional shape of the ultrafine fibers, a circular cross section is suitable though fibers having cross sections of other shapes such as an ellipse, flat shape, triangle, other polygons, sector, cross, or other irregular shapes may also be adopted.

The ultrafine fibers used for an aspect of the present invention have a filament fineness of 2 decitex or less, preferably 0.001 to 1.8 decitex, and more preferably 0.02 to 0.5 decitex. If the filament fineness of the ultrafine fibers is more than 2 decitex, it will be impossible to realize an appearance with high suede-like quality and a soft surface feel, while if the filament fineness of the ultrafine fibers is less than 0.001 decitex, the coloring ability will decrease, easily leading to poor color tone.

In a preferred embodiment, the ultrafine fibers are in the form of a sheet of an entangled fiber mass such as nonwoven fabric. Such nonwoven fabric can have a consistent, elegant appearance and texture. Nonwoven fabrics usable in the artificial leather according to the present invention include short fiber nonwoven fabrics produced by forming a laminated web from short fibers using a carding machine, cross-wrapper, or the like, and processing it by needle punching, water jet punching, or the like; long fiber nonwoven fabrics produced by spunbonding, meltblowing, or the like; and nonwoven fabrics produced by using a paper machine. In particular, short fiber nonwoven fabrics are used favorably because favorable ones with a uniform napped fiber length etc. can be obtained.

If a short fiber nonwoven fabric is to be used, the ultrafine fibers contained preferably have a fiber length of 25 mm or more and 90 mm or less. Controlling the fiber length of the ultrafine fibers at 90 mm or less ensures high quality and good texture while controlling the fiber length at 25 mm or more serves to obtain a sheet with high abrasion resistance.

A nonwoven fabric of ultrafine fiber-generating type fibers may preferably be combined with a woven fabric or knitted fabric in order to improve the strength. The combination of a nonwoven fabric with a woven fabric or knitted fabric may be achieved by laminating a nonwoven fabric with a woven fabric or knitted fabric, or inserting a woven fabric or knitted fabric into a nonwoven fabric. Of the woven fabric and knitted fabric, it is preferable to use a woven fabric from the viewpoint of expected improvement in shape stability and strength.

The yarns (warp and weft) that constitute the woven fabric may preferably be monofilaments of synthetic fiber such as polyester fiber and polyamide fiber, but they are preferably yarns of the same fiber material as the ultrafine fibers that finally constitute the cloth such as nonwoven fabric.

These yarns may be in the form of filament yarns spun yarns, of which spun yarns are preferred because spun yarns are considered to suffer easily from falling-off of surface fuzz. Furthermore, they are preferably in the form of hard twist yarns. Those hard twist yarns preferably have a twist count of 1000 T/m or more and 4000 T/m or less. A twist count of 1000 T/m or more, more preferably 1500 T/m or more, serves to prevent the breakage of monofilaments in a hard twist yarn during needle punching treatment and also prevent a deterioration in products' physical characteristics and exposure of monofilaments in the product surface. A twist count of 4000 T/m or less, more preferably 3500 T/m or less, on the other hand, serves to prevent the formation of a hard texture.

The dyed artificial leather of an aspect of the present invention has a structure in which an entangled fiber mass such as a nonwoven fabric of ultrafine fibers is impregnated with a polymeric elastomer.

The polymeric elastomers usable for the dyed artificial leather according to the present invention include polyurethane, polyurea, polyurethane/polyurea elastomer, polyacrylic acid, acrylonitrile/butadiene elastomer, and styrene/butadiene elastomer, of which polyurethane is preferable from the viewpoint of flexibility and cushioning properties.

In addition to the above components, the polymeric elastomers may also contain polyester based, polyamide based, or polyolefin based elastomer resin, acrylic resin, and ethylene-vinyl acetate resin.

There are various types of polymeric elastomers including organic solvent-soluble ones that are used in a state of being dissolved in an organic solvent and water-dispersed ones that are used in a state of being dispersed in water, both of which can work for the present invention.

Polyurethane can be produced by causing polyol, polyisocyanate, and a chain extending agent to be reacted appropriately.

Exemplary polyols include polycarbonate diols, polyester diols, polyether diols, silicone diols, fluorine diols, and copolymers produced through combination thereof. Of these, polycarbonate diols and polyester diols are preferred in view of light resistance. Also preferred are polycarbonate diols in view of hydrolytic resistance and heat resistance.

A polycarbonate diol can be produced, for example, through ester exchange reaction between alkylene glycol and carbonate or through reaction of phosgene or a chloroformate with alkylene glycol.

For example, useful alkylene glycols include linear alkylene glycols such as ethylene glycol, propylene glycol, 1,4-butane diol, 1,5-pentane diol, 1,6-hexane diol, 1,9-nonane diol, and 1,10-decane diol; branched alkylene glycols such as neopentyl glycol, 3-methyl-1, 5-pentane diol, 2,4-diethyl-1, 5-pentane diol, and 2-methyl-1, 8-octane diol; alicyclic diols such as 1,4-cyclohexane diol; aromatic diols such as bisphenol A; and others such as glycerin, trimethylol propane, and pentaerythritol.

For the present invention, each of these diols may be either a polycarbonate diol which is produced from a single alkylene glycol or a copolymerized polycarbonate diol which is produced from two or more types of alkylene glycols.

For example, usable polyisocyanates include aliphatic polyisocyanates such as hexa methylene diisocyanate, dicyclohexyl methane diisocyanate, isophorone diisocyanate, and xylylene diisocyanate; and aromatic polyisocyanates such as diphenylmethane diisocyanate and tolylene diisocyanate, which may be used in combination. In particular, the use of aromatic polyisocyanates such as diphenylmethane diisocyanate is preferred when durability and heat resistance are important while the use of aliphatic polyisocyanates such as hexamethylene diisocyanate, dicyclohexyl methane diisocyanate, and isophorone diisocyanate is preferred when light resistance are important.

Furthermore, exemplary chain extenders include amine based chain extenders such as ethylene diamine and methylene bisaniline, diol based chain extenders such as ethylene glycol, and polyamine compounds obtained by reacting polyisocyanate with water.

Furthermore, the elastic polymer used for the present invention may contain various additives including pigments such as carbon black; flame retarders such as phosphorus-based, halogen-based, and inorganic ones; antioxidants such as phenol-based, sulfur-based, and phosphorus-based ones; ultraviolet light absorbers such as benzotriazole-based, benzophenone-based, salicylate-based, cyanoacrylate-based, and oxalic acid anilide-based ones; light stabilizers such as hindered amine-based and benzoate-based ones; hydrolysis-resistant stabilizers such as polycarbodiimide; and others such as plasticizers, antistatic agents, surfactants, solidification-adjusting materials, and dyes.

The artificial leather according to the present invention preferably has a nap at least on one surface.

In the artificial leather according to an aspect of the present invention, the lightness difference $\Delta L^*$ between the ultrafine fibers and the polymeric elastomer represented by the following equation meet the requirement of $-16 \leq L^* \leq 5$, preferably $-14 \leq \Delta L^* \leq 5$, and more preferably $-8 \leq L^* \leq 5$.

$$\Delta L^* = (\text{average lightness } L^* \text{ of ultrafine fibers}) - (\text{average lightness } L^* \text{ of a polymeric elastomer}).$$

If the lightness difference $\Delta L^*$ is less than $-16$, color unevenness will occur between the ultrafine fibers and the polymeric elastomer and the surface quality will deteriorate. In the case of the present invention, the polymeric elastomer used will be more difficult to dye than the ultrafine fibers, and it is substantially impossible for the lightness difference $\Delta L^*$ to exceed 5.

Favorably, a lightness difference $\Delta L^*$ in the above range is realized by performing the second dying step after the first dying step at a dye concentration that is 0.1% to 30% of the dye concentration (owf) used in the first dyeing step, as described later.

Furthermore, the ultrafine fibers preferably has an average lightness L* of 15 to 80, more preferably 33 to 80.

On the other hand, the polymeric elastomer preferably has an average lightness L* of 20 to 85, more preferably 40 to 85.

In the conventional artificial leather products formed of ultrafine fibers, the color difference between the ultrafine fibers and the polymeric elastomer can be significantly visible when it has a red color with a hue a* of about +11 to +57, whereas the present invention can provide artificial leather with a high commercial value that has good surface quality and high dyed color fastness even in a strong red color range.

Next, the method for producing the dyed artificial leather according to an aspect of the present invention is explained below.

For example, ultrafine fibers suitable for the present invention can be produced by preparing sea-island type composite fibers composed of two or more thermoplastic resins differing in solubility in a solvent acting as sea component and island component, processing them into ultrafine fiber-generating type fibers, and removing the sea component by dissolving it with the solvent. In another method, two thermoplastic resin components are alternately arranged radially with respect to the fiber surface or in a multi-layered form, and peeling/separating them with a solvent so that they are split into ultrafine fibers in the form of peeling type composite fibers, which can be adopted as ultrafine fiber-generating type fibers. Of these, preferred in view of softness and texture of the artificial leather substrate are sea-island type composite fibers since adequate gaps can be provided among the island component regions, namely among the ultrafine fibers in the interior of the fiber bundle, by removing the sea component.

Sea-island type composite fibers can be produced by, for example, the polymer alignment type method wherein two components, namely, the sea component and the island component, are spun in an aligned manner by using a sea-island type nozzle, or the mixed spun type method wherein two components, namely, the sea component and the island component, are spun after mixing these components. Of these, sea-island type composite fibers obtained by the polymer alignment type method are preferred in view of producing ultrafine fibers having consistent fineness.

Usable materials for the sea component of island-in-sea type composite fibers include polyethylene, polypropylene, polystyrene, high molecular weight polystyrene, polyvinyl alcohol, polyester copolymers of sodiumsulfoisophthalic acid, polyethylene glycol, or the like, and polylactic acid.

These ultrafine fiber-generating type fibers are subjected to composite spinning, stretched, and preferably crimped. Subsequently, the ultrafine fiber-generating type fibers are cut to provide raw stock.

It is preferable that the resulting raw stock be subjected to carding and crosslapping to prepare a laminated fiber web in which fibers are aligned in the width direction of the sheet, followed by needle punching. From the viewpoint of forming a fiber web, it is also possible to use a random fiber web. The metsuke (weight per unit surface area) of the fiber web may be appropriately specified after considering the design of the final product, size alteration in the subsequent steps, and performance of the processing machine.

A fiber web may be subjected to needle punching or other entangling treatment to provide a short fiber nonwoven fabric formed of ultrafine fiber-generating type fibers.

In a preferred embodiment, from the viewpoint of producing denser surface fibers, a nonwoven fabric (entangled fiber mass) formed of ultrafine fiber-generating fibers is shrunk by dry heat and/or wet heat to realize a higher fiber density. The nonwoven fabric (entangled fiber mass) may be subjected to calendering treatment for compression in the thickness direction.

To dissolve out the high-solubility polymer (sea component) from the ultrafine fiber-generating fibers, an organic solvent such as toluene and trichloroethylene is used when the sea component is polyethylene, polypropylene, polystyrene, or copolymerized polystyrene. An aqueous alkali solution of sodium hydroxide or the like can be used when the sea component is, for instance, copolymerized polyester or polylactic acid. When it is hot water soluble polyester or polyvinyl alcohol, hot water is used and ultrafine fiber-generating type fibers (a nonwoven fabric formed thereof) may be immersed in a solvent, solution, or the like, followed by squeezing out the liquid to remove the sea component.

To generate ultrafine fibers, generally known instruments such as continuous dyeing machine, vibro-washer type sea component removing machine, jet dyeing machine, wince dyeing machine, and jigger dyeing machine can be used.

For the present invention, treatment of generating ultrafine fibers from may be either preceded or followed by the treatment of applying the polymeric elastomer. When the treatment for generating ultrafine fibers is carried out first, the polymeric elastomer will grasp the ultrafine fibers and removal of the ultrafine fibers is thereby prevented, which will enable the production of a product that can be used for a longer period. On the other hand, when the application of a polymeric elastomer is conducted first, the ultrafine fibers will not be structurally held by the polymeric elastomer, and the resulting artificial leather will have a good texture. The order of these treatments may be appropriately selected depending on the type of polymeric elastomer used.

When the application of a polymeric elastomer is conducted after the treatment for generating ultrafine fibers, a step for adding a water-soluble resin to the entangled fiber mass such as nonwoven fabric is preferably carried out between the two steps. To provide a step for adding a water-soluble resin between the two steps as described above allows it to come in contact with the polymeric elastomer sporadically, rather than continuously, on the fiber bundles or fiber surface of ultrafine fibers, serving to depress the adhesion area appropriately. As a consequence, the resulting artificial leather will have a good texture simultaneously with good grip feeling realized by the polymeric elastomer.

Examples of such water-soluble resins include polyvinyl alcohol, polyethylene glycol, saccharide, and starch. Of these, the preferred are polyvinyl alcohols having a saponification degree of 80% or more.

Exemplary methods used for applying a water-soluble resin to an entangled fiber mass include the impregnation of the entangled fiber mass with an aqueous solution of the water-soluble resin followed by drying. With respect to the drying conditions including the drying temperature and drying time, the temperature of the entangled fiber mass that contains the water-soluble resin is preferably suppressed to a temperature of 110° C. or less.

The amount of the water-soluble resin to be applied is preferably 1% to 30% by weight relative to the weight of the entangled fiber mass immediately before the application. An addition of 1% or more by weight serves to develop a good texture as well as high stretchability when using a woven or knitted fabric formed of side-by-side or other type composite structures. At the same time, an application amount of 30% by weight or less will lead to good workability, and hence, allow the production of an artificial leather exhibiting good physical properties including abrasion resistance. Such an amount also allows an increased amount of the polymeric elastomer applied to the entangled fiber mass in the subsequent steps, and the resulting artificial leather will have a high density as well as a dense texture.

The amount of the water-soluble resin applied is more preferably 2 wt % or more and 20 wt % or less, and most preferably 3 wt % or more and 10 wt % or less. The water-soluble resin applied will be removed, for example, with hot water after the application of a polymeric elastomer.

In a preferable embodiment, shrinkage treatment is performed after adding a polymeric elastomer to ultrafine fibers and coagulating the polymeric elastomer. Preferable shrinkage treatment techniques include dry heat treatment using a known non-tension dryer or a tenter and bath treatment using a jet dyeing machine (high pressure).

The resulting sheet composed mainly of a fibrous base containing ultrafine fibers and a polymeric elastomer is buffed to nap the sheet surface to form a nap. The buffing or napping treatment can be accomplished by buffing the surface of the nonwoven fabric with sand paper or roll sander. In particular, if sand paper is used, a consistent, dense nap can be formed on the surface of the nonwoven fabric. In order to form consistent napping over the surface of artificial leather, the use of a smaller grinding load is preferable. To reduce the grinding load, the buffing is preferably conducted by multiple-stage buffing of three or more stages, and the sandpaper used in each stage is preferably in the range of JIS No. 150 to 600. A surface with a consistent napping length can be produced by gradually changing sandpapers from large to small grit sizes.

A gray fabric of artificial leather is prepared in this way.

For the production method for dyed artificial leather according to an aspect of the present invention, it is important to perform the first dying step using a dye for the artificial leather, followed by performing the second dying step at a dye concentration that is 0.1% to 30% of the dye concentration (owf) used in the first dyeing step. In this way, these steps serve to produce dyed artificial leather ensuring consistent dyeability for the polymeric elastomer and consistent coloring for the ultrafine fibers, regardless of the type of dye used.

Here, "owf" generally represents the dye concentration in a fiber product, but for the present invention, it refers to the dye concentration in artificial leather containing a polymeric elastomer.

Useful dyes for the first dying step include disperse dyes, cationic dyes, acidic dyes, and indanthrene dyes. Disperse dyes are suitable for dyeing polyester based fibers and the like. Useful disperse dyes include azo based, anthraquinone based, and quinophtharone based ones. Cationic dyes are suitable to dye copolymerized polyester based fibers containing a functional group with a dyeability for cationic dyes. A cationic dye is generally a water-soluble salt composed of a dye cation having a positive charge in the color developing site and a colorless anion, and according to the chemical structure, cationic dyes are divided into triaryl methane based, methine based, azo based, azamethylene based, and anthraquinone based ones. Acidic dyes, furthermore, are suitable to dye polyamide based fibers including nylon. Acidic dyes include azo based, anthraquinone based, pyrazolone based, phthalocyanine based, xanthene based, indigoid based, and triphenyl methane based ones. Indanthrene dyes include anthraquinone based and indigo based ones.

The dyeing temperature in the first dying step is preferably 90° C. to 140° C., more preferably 95° C. to 130° C., and still more preferably 100° C. to 125° C. An appropriate dyeing period is decided depending on the type of fibers to be used. Dyeing at a dyeing temperature 90° C. or more serves to ensure an adequate degree of coloring, a target degree of hue even in the case of a deep color, and an adequate degree of fastness. When it is 140° C. or less, a stable temperature required for process management can be maintained, ensuring a small color variance and dyeing unevenness.

The dye concentration in the first dying step is preferably 0.05% to 30% owf, more preferably 0.07% to 10% owf, and still more preferably 0.10% to 5% owf. A dye concentration of 0.05% owf or more ensures an adequate coloring of the fiber and a target hue. If it is 30% owf or less, excessive dye attachment is depressed and deterioration in fastness is prevented.

After the first dying step, it is important that the concentration of the dye added to the dye liquor for the second dying step be 0.1% to 30%, preferably 0.2% to 20%, and more preferably 0.3% to 10%, of the dye concentration in the first dying step. If a dye is added in such manner that the dye concentration is less than 0.1%, the polymeric elastomer will not be colored sufficiently and color discontinuity can occur between the polymeric elastomer and ultrafine fibers, leading to color unevenness. If it is more than 30%, the dye will be attached excessively to the polymeric elastomer and the fastness will deteriorate although color continuity may be realized.

After the first dying step, washing treatment or fixation treatment may be performed before the second dying step. If a disperse dye or a cationic dye is used in the first dying step, the washing treatment is preferably achieved by (hot) water rinsing, soaping, or reduction cleaning. If an acidic dye is used in the first dying step, it is preferable to perform dye fixation treatment.

With respect to the type of washing treatment, hot water rinsing is preferably performed in a dying machine at a temperature of 40° C. to 60° C. for 10 to 20 minutes. Soaping treatment uses a surface active agent to remove the excess dye attached on the ultrafine fibers and polymeric elastomer. Reduction cleaning uses sodium hydroxide, reduction agent, and the like for reductive decomposition of the dye attached on the ultrafine fibers and polymeric elastomer, thus serving to remove the excess dye attached on the artificial leather surface. With respect to the reduction agent, any generally used reduction agent may be used. Specific examples include thiourea dioxide, hydrosulfite sodium, hydrosulfite calcium, other hydrosulfite based compounds, zinc sulfoxylate aldehyde, sodium sulfoxylate aldehyde, cetyltrimethylammonium bromide, octadecylpyridinium bromide, and sodium hydrogen sulfite.

Fixation treatment is intended to improve the wet fastness after dyeing artificial leather with an acidic dye. Useful synthetic tannin fixation agents for the fixation treatment include resins having an aromatic phenolic hydroxyl group. Examples of the resins having an aromatic phenolic hydroxyl group include phenolsulfonic acid formaldehyde resin, sulfonated products of novolac type resin, and methanesulfonated products of resol type resin. These resins having an aromatic phenolic hydroxyl group can be used singly or as a blend. The treatment can be performed in a dying machine preferably at a temperature of 70° C. to 80° C. for 20 to 30 minutes.

The dyeing temperature in the second dying step is preferably lower than the dyeing temperature in the first dying step. It further ensures the production of artificial leather free of color unevenness between the ultrafine fibers and the polymeric elastomer. With respect to the mechanism, since the comparison between the polymer constituting the ultrafine fibers and the polymeric elastomer shows that the polymeric elastomer has a lower glass transition temperature, the dye is not attached strongly to the polymeric elastomer in the first dying step, whereas the dye is attached selectively depending on the polymeric elastomer in the second dying step.

The dyeing temperature in the second dying step is preferably 60° C. to 90° C., more preferably 65° C. to 85° C., and still more preferably 70° C. to 80° C. A dyeing temperature of 60° C. or more ensures adequate dye attachment on the polymeric elastomer and color continuity to the ultrafine fibers, thus preventing color unevenness. A temperature of 90° C. or less, on the other hand, prevents progress of dye adsorption to the ultrafine fibers and realizes adequate dye attachment on the polymeric elastomer, thus ensuring color continuity to the ultrafine fibers.

The dyeing treatment period in the second dying step is preferably 10 to 45 minutes, more preferably 15 to 40 minutes, still more preferably 20 to 35 minutes.

The dye used in the second dying step may be the same as that used in the first dying step. Applying the same dye as in the first dying step to the second dying step is preferable because even color continuity can be achieved without complicated adjustment.

With respect to the dying machine to be used, it is preferable to use a high-temperature, high-pressure dying machine because the dyed artificial leather will have a flexible texture.

It is preferable to perform washing treatment and fixation treatment after the second dying step as well. Appropriate types of treatment are selected depending on the type dye used, as described regarding the washing treatment and fixation treatment to be performed after the first dying step.

For the present invention, furthermore, finish treatment may be performed by using a flexible agent such as silicone, antistatic agent, water repellent agent, flame retardant, or light resistant agent. Such finishing treatment may be performed after dyeing or simultaneously with dyeing in the same bath. The flame retardant treatment may be accomplished by using a halogen based flame retardant such as bromine or chlorine flame retardant, or a non-halogen flame retardant such as phosphorus flame retardant, and the addition of a flame retardant may be conducted by immersion after the dyeing step or by back-coating techniques such as knife coating and rotary screen printing.

With a soft feel and texture as well as high quality appearance, the dyed artificial leather according to the present invention can be used in a wide variety of applications including garments, furniture, shoes, wallpaper, industrial materials, and automobile interior materials.

EXAMPLES

The dyed artificial leather according to the present invention and the production method therefor are described in more detail below with reference to Examples, although the present invention is not limited only to these Examples.

The evaluation methods used are described blow. Unless otherwise specified, measurements were taken at three positions aligned in the length direction and another three positions aligned in the width direction and the average of the six measurements was adopted for evaluation.

(1) Surface Quality (Color Continuity Between the Ultrafine Fibers and the Polymeric Elastomer):

Surface quality was evaluated according to the criteria given below based on sensory test by 10 testers. A specimen was judged to be acceptable if ranked as either ◎ or ○.

◎: Eight or more testers judged that color continuity was maintained between the ultrafine fibers and the polymeric elastomer and that color unevenness was not found.

○: Five to seven testers judged that color continuity was maintained between the ultrafine fibers and the polymeric elastomer and that color unevenness was not found.

Δ: Three to four testers judged that color continuity was maintained between the ultrafine fibers and the polymeric elastomer and that color unevenness was not found.

x: Two or less testers judged that color continuity was maintained between the ultrafine fibers and the polymeric elastomer and color unevenness was not found.

For the color continuity evaluation, the illuminance of external light was 200 Lx or less and the discoloration determined by visual observation was 4.75 or more on the gray scale (for JIS color fastness test).

(2) Lightness Difference ΔL* and Average Hue a*:

Measurements were taken using a micro-surface spectral color difference meter (VSS400, manufactured by Nippon Denshoku Industries Co., Ltd.) with a light source D of 65, a view angle of 10 degrees, and a measuring diameter of 0.03 mm under optical conditions for reflection settings as specified in JIS Z-8729 (2008). A 100 mm×100 mm test piece was cut out of an artificial leather sample. Measurements were taken at ten positions selected at random on the ultrafine fibers in the surface and the averages were adopted as the average lightness L* and the average hue a* of the ultrafine fibers. For the polymeric elastomer in the surface, on the other hand, the ten largest polymeric elastomer masses in the test piece were selected for measurement and the average of the measurements was adopted as the average lightness L* of the polymeric elastomer. Here, for each polyurethane mass, the point with the highest lightness L* was used for measurement.

The lightness difference ΔL* was calculated from the lightness L* obtained above by Equation (1) given below.

$$\Delta L^* = (\text{average lightness } L^* \text{ of ultrafine fibers}) - (\text{average lightness } L^* \text{ of polymeric elastomer}) \quad (1)$$

(3) Washing Fastness:

Evaluation was performed according to JIS L 0844 (Method A) (2011).

(4) Rubbing Fastness:

Evaluation was performed according to JIS L 0842 (Gakushin type method) (2011).

(5) Light Fastness:

Evaluation was performed according to JIS L 0842 (2011).

Example 1

<Raw Stock>

Polyethylene terephthalate used as material of the island component and polystyrene used as material of the sea component were melt-spun through a spinneret designed for 16-island sea-island type composite fiber with an island component/sea component mass ratio of 80/20, followed by stretching and crimping of the spun yarn, and subsequent cutting to a 51 mm length to prepare raw stock of sea-island type composite fiber with a filament fineness of 4.2 dtex.

<Nonwoven Fabric>

The raw stock for sea-island type composite fiber prepared above was subjected to carding and crosslapping to form a laminated fiber web, which was then subjected to needle punching at a punching rate of 100 punches/cm$^2$. Subsequently, additional needle punching was performed at a punching rate (density) of 2,500 punches/cm$^2$ to produce a nonwoven fabric of ultrafine fiber-generating type fibers with a metsuke of 714 g/m$^2$ and a thickness of 2.9 mm.

<Artificial Leather>

The nonwoven fabric prepared in the above step was shrunk by shrinkage treatment using hot water at a temperature of 96° C. and then the nonwoven fabric was impregnated with an aqueous solution of PVA (polyvinyl alcohol) and dried in hot air at a temperature of 110° C. for 10 minutes to provide a sheet base in which PVA accounted for 7.6 mass % of the nonwoven fabric. This sheet base was immersed in trichloroethylene to dissolve and remove the polystyrene sea component to provide a sea-deprived nonwoven fabric formed of ultrafine fibers with a filament fineness of 0.04 decitex. The resulting sea-deprived nonwoven fabric formed of ultrafine fibers was immersed in a solution of a polymeric elastomer in DMF (dimethyl formamide) with a solid content adjusted to 12%, followed by coagulating the polymeric elastomer in an aqueous solution with a 30% DMF concentration. Subsequently, PVA and DMF were removed with hot water and dried in hot air at a temperature of 110° C. for 10 minutes to provide artificial leather in which the polymeric elastomer accounted for 27 mass % of the ultrafine fibers formed of the island component.

The artificial leather thus obtained was cut in half in the thickness direction, i.e. in the perpendicular direction to the nonwoven fabric layer in the artificial leather, and the half-cut sheet surface was ground with endless sandpaper with a sandpaper roughness number 320 to nap the exposed layer, thereby providing suede-like artificial leather gray fabric with a thickness of 1.1 mm.

<First Dying Step>

The artificial leather gray fabric prepared in the above step was dyed using a jet dyeing machine. The dyeing conditions used were as described below.

Disperse dye: Sumikaron (registered trademark) Red E-FBL (manufactured by Sumitomo Chemical Co., Ltd.): 10% owf
Acetic acid (90%): 1 g/liter
Sodium acetate: 0.15 g/liter
Sumipon (registered trademark) TF (manufactured by Sumitomo Chemical Co., Ltd.): 1.0 g/liter
Bath ratio: 1:20
Dyeing temperature and time: 125° C. for 45 minutes <Reduction Cleaning>

Caustic soda (48° Be (Baume scale)): 3.6 g/liter
Hydrosulfite: 3.6 g/liter
Sandet (registered trademark) G-29 (manufactured by Sanyo Chemical Industries Ltd.): 1.2 g/liter
Bath ratio: 1:20
Treatment temperature and time: 80° C. for 20 minutes Subsequently, washing in hot water and normal temperature water was performed thoroughly and then dying was performed in the second dying step (additional dye).

<Second Dying Step>

Additional dye: disperse dye Sumikaron (registered trademark) Red E-FBL (manufactured by Sumitomo Chemical Co., Ltd.): 0.1% owf
Acetic acid (90%): 1 g/liter
Sodium acetate: 0.15 g/liter Sumipon (registered trademark) TF (manufactured by Sumitomo Chemical Co., Ltd.): 1.0 g/liter Bath ratio: 1:20

Dyeing temperature and time: 80° C. for 20 minutes

Subsequently, washing in hot water and normal temperature water was performed thoroughly and then widening and dehydration were conducted, followed by heat setting treatment for finishing at a temperature of 120° C. The dyed artificial leather thus obtained was a red colored artificial leather with a good surface quality and high color fastness to ensure a high commercial value. Results are given in Table 1.

Example 2

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<First Dying Step>

The artificial leather gray fabric prepared in the above step was dyed using a jet dyeing machine. The dyeing conditions used were as described below.

Disperse dye: Sumikaron (registered trademark) Blue E-FBL (manufactured by Sumitomo Chemical Co., Ltd.): 15% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 125° C. for 60 minutes

<Reduction Cleaning>

Caustic soda (48° Be (Baume scale)): 3.6 g/liter

Hydrosulfite: 3.6 g/liter

Sandet (registered trademark) G-29 (manufactured by Sanyo Chemical Industries Ltd.): 1.2 g/liter Bath ratio: 1:20

Dyeing temperature and time: 80° C. for 20 minutes

Subsequently, washing in hot water and normal temperature water was performed thoroughly and then dying was performed in the second dying step (additional dye).

<Second Dying Step>

Additional dye: disperse dye Sumikaron (registered trademark) Blue E-FBL (manufactured by Sumitomo Chemical Co., Ltd.): 0.75% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 80° C. for 20 minutes

Subsequently, washing in hot water and normal temperature water was performed thoroughly and then widening and dehydration were conducted, followed by heat setting treatment for finishing at a temperature of 120° C. The dyed artificial leather thus obtained was a blue colored one with a good surface quality and high color fastness to ensure a high commercial value. Results are given in Table 1.

Example 3

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<First Dying Step>

The artificial leather gray fabric prepared in the above step was dyed using a jet dyeing machine. The dyeing conditions used were as described below.

Disperse dye: Sumikaron (registered trademark) Yellow SE-RPD (manufactured by Sumitomo Chemical Co., Ltd.): 5% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 125° C. for 45 minutes

Subsequently, washing in hot water and normal temperature water was performed thoroughly and then dying was performed in the second dying step (additional dye).

<Second Dying Step>

Additional dye: disperse dye Sumikaron (registered trademark) Yellow SE-RPD (manufactured by Sumitomo Chemical Co., Ltd.): 0.025% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 80° C. for 20 minutes

Subsequently, washing in hot water and normal temperature water was performed thoroughly and then widening and dehydration were conducted, followed by heat setting treatment for finishing at a temperature of 120° C. The dyed artificial leather thus obtained was a yellow colored one with a good surface quality and high color fastness to ensure a high commercial value. Results are given in Table 1.

Example 4

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<First Dying Step>

The artificial leather gray fabric prepared in the above step was dyed using a jet dyeing machine. The dyeing conditions used were as described below.

Disperse dye: Dianix (registered trademark) Black HLA (manufactured by DyStar): 12% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 125° C. for 60 minutes

<Reduction Cleaning>

Caustic soda (48° Be (Baume scale)): 3.6 g/liter

Hydrosulfite: 3.6 g/liter

Sandet (registered trademark) G-29 (manufactured by Sanyo Chemical Industries Ltd.): 1.2 g/liter Bath ratio: 1:20

Treatment temperature and time: 80° C. for 20 minutes

Subsequently, washing in hot water and normal temperature water was performed thoroughly and then dying was performed in the second dying step (additional dye).

<Second Dying Step>

Additional dye: cationic dye Cathilon (registered trademark) Black CD-BLH (manufactured by Hodogaya Chemical Co., Ltd.): 0.6% owf Acetic acid (90%): 1 g/liter Sodium acetate: 0.15 g/liter Bath ratio: 1:20

Dyeing temperature and time: 80° C. for 20 minutes

Subsequently, washing in hot water and normal temperature water was performed thoroughly and then widening and dehydration were conducted, followed by heat setting treatment for finishing at a temperature of 120° C. The dyed artificial leather thus obtained was a black colored one with a good surface quality and high color fastness to ensure a high commercial value. Results are given in Table 1.

Example 5

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<First Dying Step>

The artificial leather gray fabric prepared in the above step was dyed using a jet dyeing machine. The dyeing conditions used were as described below.

Disperse dye: Sumikaron (registered trademark) Yellow SE-RPD (manufactured by Sumitomo Chemical Co., Ltd.): 0.05% owf Sumikaron (registered trademark) Red E-FBL (manufactured by Sumitomo Chemical Co., Ltd.): 0.03% owf Sumikaron (registered trademark) Blue E-FBL (manufactured by Sumitomo Chemical Co., Ltd.): 0.03% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 125° C. for 45 minutes

<Reduction Cleaning>

Caustic soda (48° Be (Baume scale)): 3.6 g/liter

Hydrosulfite: 3.6 g/liter

Sandet (registered trademark) G-29 (manufactured by Sanyo Chemical Industries Ltd.): 1.2 g/liter Bath ratio: 1:20

Treatment temperature and time: 80° C. for 20 minutes

Subsequently, washing in hot water and normal temperature water was performed thoroughly and then dying was performed in the second dying step (additional dye).

<Second Dying Step>

Additional dye: acid dye Irgalan (registered trademark) Gray GL (manufactured by Ciba Specialty Chemicals): 0.018% owf Acetic acid (90%): 1 g/liter Sodium acetate: 0.15 g/liter Levelan NKD (manufactured by Marubishi Oil Chemical Corporation): 1 g/liter Bath ratio: 1:20

Dyeing temperature and time: 90° C. for 20 minutes

Subsequently, washing in hot water and normal temperature water was performed thoroughly and then widening and dehydration were conducted, followed by heat setting treatment for finishing at a temperature of 120° C. The dyed artificial leather thus obtained was a gray colored one with a good surface quality and high color fastness to ensure a high commercial value. Results are given in Table 1.

Example 6

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<First Dying Step>

The artificial leather gray fabric prepared in the above step was dyed using a jet dyeing machine. The dyeing conditions used were as described below.

Disperse dye: Sumikaron (registered trademark) Red E-FBL (manufactured by Sumitomo Chemical Co., Ltd.): 1.1% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 125° C. for 60 minutes

<Reduction Cleaning>

Caustic soda (48° Be (Baume scale)): 3.6 g/liter

Hydrosulfite: 3.6 g/liter

Sandet (registered trademark) G-29 (manufactured by Sanyo Chemical Industries Ltd.): 1.2 g/liter Bath ratio: 1:20

Treatment temperature and time: 80° C. for 20 minutes

Subsequently, washing in hot water and normal temperature water was performed thoroughly and then dying was performed in the second dying step (additional dye).

<Second Dying Step>

Additional dye: disperse dye Sumikaron (registered trademark) Red E-FBL (manufactured by Sumitomo Chemical Co., Ltd.): 0.286% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 80° C. for 20 minutes

Subsequently, washing in hot water and normal temperature water was performed thoroughly and then widening and dehydration were conducted, followed by heat setting treatment for finishing at a temperature of 120° C. The dyed artificial leather thus obtained was a red colored one with a good surface quality and high color fastness to ensure a high commercial value. Results are given in Table 1.

TABLE 1

| | | | | Example 1 | Example 2 | Example 3 | Example 4 | Example 5 | Example 6 |
|---|---|---|---|---|---|---|---|---|---|
| Components of artificial leather | | ultrafine fiber | | polyester fiber | polyester fiber | polyester fiber | polyester fiber | polyester fiber | polyester fiber |
| | | polymeric elastomer | | polyurethane resin | polyurethane resin | polyurethane resin | polyurethane resin | polyurethane resin | polyurethane resin |
| Dyeing conditions | 1st dying step | dye type | | disperse dye | disperse dye | disperse dye | disperse dye | disperse dye | disperse dye |
| | | Color | | red | blue | yellow | black | gray | red |
| | | dye concentration | | 10% owf | 15% owf | 5% owf | 12% owf | 0.11% owf | 1.1% owf |
| | | washing conditions (hot water, reduction cleaning, fixation) | | reduction cleaning | reduction cleaning | hot water | reduction cleaning | reduction cleaning | reduction cleaning |
| | 2nd dying step | dye type | | disperse dye | disperse dye | disperse dye | cationic dye | acid dye | disperse dye |
| | | proportion of dye quantity relative to 1st dying step (actual dye concentration) | | 1% (0.1% owf) | 5% (0.75% owf) | 0.5% (0.025% owf) | 0.6% (0.072% owf) | 16.4% (0.018% owf) | 26% (0.286% owf) |
| | | dyeing temperature (° C.) | | 80 | 80 | 80 | 80 | 90 | 80 |
| Evaluation results | surface quality | sensory evaluation (color continuity between ultrafine fiber and polymeric elastomer) | | ◎ | ◎ | ○ | ○ | ◎ | ◎ |
| | | average lightness L* of ultrafine fiber | | 35.53 | 19.81 | 73.29 | 25.07 | 63.21 | 49.19 |
| | | average lightness L* of polyurethane resin | | 42.86 | 26.03 | 84.88 | 39.88 | 65.66 | 56.42 |
| | | lightness difference ΔL* | | −7.33 | −6.22 | −11.59 | −14.81 | −2.45 | −7.23 |
| | | average hue a* of ultrafine fiber | | 39.80 | 5.50 | 4.65 | −0.50 | 2.84 | 46.92 |
| | color fastness | washing fastness (specification: class) | color change (class 4) | 4-5 | 4 | 4-5 | 4 | 4 | 4-5 |
| | | | staining (class 3) | 4 | 4 | 4-5 | 4 | 4 | 4 |
| | | | fading (class 2-3) | 3 | 3 | 3-4 | 3 | 3 | 3 |
| | | rubbing fastness (specification: class) | dry class 4) | 4 | 4 | 4-5 | 4 | 4 | 4 |
| | | | wet (class 3) | 4 | 3-4 | 4 | 3-4 | 3-4 | 4 |
| | | light fastness (specification: class) | color change (class 3) | 4 | 4 | 4 | 4 | 4 | 4 |

Example 7

<Raw Stock> nylon 6 used as material of the island component and polystyrene used as material of the sea component were melt-spun through a spinneret designed for 16-island sea-island type composite fiber with an island component/sea component mass ratio of 80/20, followed by stretching and crimping of the spun yarn, and subsequent cutting to a 51 mm length to prepare raw stock of sea-island type composite fiber with a filament fineness of 4.2 dtex.

<Nonwoven Fabric>

The raw stock for sea-island type composite fiber obtained as described above was subjected to carding and crosslapping to form a laminated fiber web, which was then subjected to needle punching at a punching rate of 100 punches/cm$^2$. Subsequently, additional needle punching was performed at a punching rate (density) of 2,500 punches/cm$^2$ to produce a nonwoven fabric of ultrafine fiber-generating type fibers with a metsuke of 714 g/m$^2$ and a thickness of 2.9 mm.

<Artificial Leather>

The nonwoven fabric prepared in the above step was shrunk by shrinkage treatment using hot water at a temperature of 96° C. and then the nonwoven fabric was impregnated with an aqueous solution of PVA (polyvinyl alcohol) and dried in hot air at a temperature of 110° C. for 10 minutes to provide a sheet base in which PVA accounted for 7.6 mass % of the nonwoven fabric. This sheet base was immersed in trichloroethylene to dissolve and remove the polystyrene sea component to provide a sea-deprived nonwoven fabric formed of ultrafine fibers with a filament fineness of 0.04 decitex. The resulting sea-deprived nonwoven fabric formed of ultrafine fibers was immersed in a solution of a polymeric elastomer in DMF (dimethyl formamide) with a solid content adjusted to 12%, followed by coagulating the polymeric elastomer in an aqueous solution with a 30% DMF concentration. Subsequently, PVA and DMF were removed with hot water and dried in hot air at a temperature of 110° C. for 10 minutes to provide artificial leather in which the polymeric elastomer accounted for 27 mass % of the ultrafine fibers of the island component.

The artificial leather thus obtained was cut in half in the thickness direction, i.e. in the perpendicular direction to the nonwoven fabric layer in the artificial leather, and the half-cut sheet surface was ground with endless sandpaper with a sandpaper roughness number 320 to nap the exposed layer, thereby providing suede-like artificial leather gray fabric with a thickness of 1.1 mm.

<First Dying Step>

The artificial leather gray fabric prepared in the above step was dyed using a jet dyeing machine. The dyeing conditions used were as described below.

Acid dye: Irgalan Gray GL: 1% owf
Acetic acid (90%): 1 g/liter
Sodium acetate: 0.15 g/liter
Levelan NKD (manufactured by Marubishi Oil Chemical Corporation): 1 g/liter
Bath ratio: 1:20
Dyeing temperature and time: 100° C. for 20 minutes
Subsequently, washing in hot water and normal temperature water was performed thoroughly and then dying was performed in the second dying step (additional dye).

<Second Dying Step>

Additional dye: acid dye Irgalan Gray GL: 0.1% owf
Acetic acid (90%): 1 g/liter
Sodium acetate: 0.15 g/liter Levelan NKD (manufactured by Marubishi Oil Chemical Corporation): 1 g/liter
Bath ratio: 1:20
Dyeing temperature and time: 80° C. for 20 minutes Subsequently, washing in hot water and normal temperature water was performed thoroughly and then widening and dehydration were conducted, followed by heat setting treatment for finishing at a temperature of 120° C. The dyed artificial leather thus obtained was a gray colored one with a good surface quality and high color fastness to ensure a high commercial value. Results are given in Table 2.

Example 8

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<First Dying Step>

The artificial leather gray fabric prepared in the above step was dyed using a jet dyeing machine. The dyeing conditions used were as described below.

Disperse dye: Dianix (registered trademark) Rubine S2G 150% (manufactured by DyStar): 10% owf
Acetic acid (90%): 1 g/liter
Sodium acetate: 0.15 g/liter
Sumipon (registered trademark) TF (manufactured by Sumitomo Chemical Co., Ltd.): 1.0 g/liter
Bath ratio: 1:20
Dyeing temperature and time: 125° C. for 45 minutes <Reduction Cleaning>

Caustic soda (48° Be (Baume scale)): 3.6 g/liter
Hydrosulfite: 3.6 g/liter
Sandet (registered trademark) G-29 (manufactured by Sanyo Chemical Industries Ltd.): 1.2 g/liter
Bath ratio: 1:20
Treatment temperature and time: 80° C. for 20 minutes Subsequently, washing in hot water and normal temperature water was performed thoroughly and then dying was performed in the second dying step (additional dye).

<Second Dying Step>

Additional dye: disperse dye Dianix (registered trademark) Rubine S2G 150%: 0.1% owf
Acetic acid (90%): 1 g/liter
Sodium acetate: 0.15 g/liter
Sumipon (registered trademark) TF (manufactured by Sumitomo Chemical Co., Ltd.): 1.0 g/liter
Bath ratio: 1:20
Dyeing temperature and time: 80° C. for 20 minutes Subsequently, washing in hot water and normal temperature water was performed thoroughly and then widening and dehydration were conducted, followed by heat setting treatment for finishing at 120° C. The dyed artificial leather thus obtained was a red colored one with a good surface quality and high color fastness to ensure a high commercial value. Results are given in Table 2.

Example 9

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<First Dying Step>

The artificial leather gray fabric prepared in the above step was dyed using a jet dyeing machine. The dyeing conditions used were as described below.

Disperse dye: Sumikaron (registered trademark) Red E-FBL (manufactured by Sumitomo Chemical Co., Ltd.): 10% owf
Acetic acid (90%): 1 g/liter
Sodium acetate: 0.15 g/liter
Sumipon (registered trademark) TF (manufactured by Sumitomo Chemical Co., Ltd.): 1.0 g/liter
Bath ratio: 1:20
Dyeing temperature and time: 125° C. for 60 minutes <Reduction Cleaning>

Caustic soda (48° Be (Baume scale)): 3.6 g/liter
Hydrosulfite: 3.6 g/liter
Sandet (registered trademark) G-29 (manufactured by Sanyo Chemical Industries Ltd.): 1.2 g/liter
Bath ratio: 1:20
Treatment temperature and time: 80° C. for 20 minutes Subsequently, washing in hot water and normal temperature water was performed thoroughly and then dying was performed in the second dying step (additional dye).

<Second Dying Step>

Additional dye: disperse dye Sumikaron (registered trademark) Red E-FBL (manufactured by Sumitomo Chemical Co., Ltd.): 0.01% owf
Acetic acid (90%): 1 g/liter
Sodium acetate: 0.15 g/liter
Sumipon (registered trademark) TF (manufactured by Sumitomo Chemical Co., Ltd.): 1.0 g/liter
Bath ratio: 1:20
Dyeing temperature and time: 80° C. for 20 minutes Subsequently, washing in hot water and normal temperature water was performed thoroughly and then widening and dehydration were conducted, followed by heat setting treatment for finishing at a temperature of 120° C. The dyed artificial leather thus obtained was a red colored one with a good surface quality and high color fastness to ensure a high commercial value. Results are given in Table 2.

Example 10

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<First Dying Step>

Disperse dye: Sumikaron (registered trademark) Red E-FBL (manufactured by Sumitomo Chemical Co., Ltd.): 0.11% owf
Acetic acid (90%): 1 g/liter
Sodium acetate: 0.15 g/liter
Sumipon (registered trademark) TF (manufactured by Sumitomo Chemical Co., Ltd.): 1.0 g/liter
Bath ratio: 1:20
Dyeing temperature and time: 125° C. for 45 minutes <Reduction Cleaning>

Caustic soda (48° Be (Baume scale)): 3.6 g/liter

Hydrosulfite: 3.6 g/liter

Sandet (registered trademark) G-29 (manufactured by Sanyo Chemical Industries Ltd.): 1.2 g/liter Bath ratio: 1:20

Treatment temperature and time: 80° C. for 20 minutes

Subsequently, washing in hot water and normal temperature water was performed thoroughly and then dying was performed in the second dying step (additional dye).

<Second Dying Step>

Additional dye: disperse dye Sumikaron (registered trademark) Red E-FBL (manufactured by Sumitomo Chemical Co., Ltd.): 0.018% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 80° C. for 20 minutes

Subsequently, washing in hot water and normal temperature water was performed thoroughly and then widening and dehydration were conducted, followed by heat setting treatment for finishing at a temperature of 120° C. The dyed artificial leather thus obtained was a red colored artificial leather with a good surface quality and high color fastness to ensure a high commercial value. Results are given in Table 2.

Example 11

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<First Dying Step>

Disperse dye: Sumikaron (registered trademark) Red E-FBL (manufactured by Sumitomo Chemical Co., Ltd.): 0.40% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 125° C. for 45 minutes

<Reduction Cleaning>

Caustic soda (48° Be (Baume scale)): 3.6 g/liter

Hydrosulfite: 3.6 g/liter

Sandet (registered trademark) G-29 (manufactured by Sanyo Chemical Industries Ltd.): 1.2 g/liter Bath ratio: 1:20

Treatment temperature and time: 80° C. for 20 minutes

Subsequently, washing in hot water and normal temperature water was performed thoroughly and then dying was performed in the second dying step (additional dye).

<Second Dying Step>

Additional dye: disperse dye Sumikaron (registered trademark) Red E-FBL (manufactured by Sumitomo Chemical Co., Ltd.): 0.040% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 80° C. for 20 minutes

Subsequently, washing in hot water and normal temperature water was performed thoroughly and then widening and dehydration were conducted, followed by heat setting treatment for finishing at a temperature of 120° C. The dyed artificial leather thus obtained was a red colored artificial leather with a good surface quality and high color fastness to ensure a high commercial value. Results are given in Table 2.

TABLE 2

| | | | | Example 7 | Example 8 | Example 9 | Example 10 | Example 11 |
|---|---|---|---|---|---|---|---|---|
| Components of artificial leather | | ultrafine fiber | | nylon 6 fiber | polyester fiber | polyester fiber | polyester fiber | polyester fiber |
| | | polymeric elastomer | | polyurethane resin | polyurethane resin | polyurethane resin | polyurethane resin | polyurethane resin |
| Dyeing conditions | 1st dying step | dye type | | acid dye | disperse dye | disperse dye | disperse dye | disperse dye |
| | | Color | | gray | red | red | red | red |
| | | dye concentration | | 1% owf | 10% owf | 10% owf | 0.11% owf | 0.40% owf |
| | | washing conditions (hot water, reduction cleaning, fixation) | | hot water | reduction cleaning | reduction cleaning | reduction cleaning | reduction cleaning |
| | 2nd dying step | dye type | | acid dye | disperse dye | disperse dye | disperse dye | disperse dye |
| | | proportion of dye quantity relative to 1st dying step (actual dye concentration) | | 10% (0.1% owf) | 1% (0.1% owf) | 0.1% (0.01% owf) | 16.4% (0.018% owf) | 10% (0.040% owf) |
| | | dyeing temperature (° C.) | | 80 | 80 | 80 | 80 | 80 |
| Evaluation results | surface quality | sensory evaluation (color continuity between ultrafine fiber and polymeric elastomer) | | ◎ | ◎ | ○ | ◎ | ◎ |
| | | average lightness L* of ultrafine fiber | | 54.58 | 33.82 | 35.65 | 75.56 | 61.14 |
| | | average lightness L* of polyurethane resin | | 58.11 | 41.12 | 50.05 | 81.20 | 67.64 |
| | | lightness difference ΔL* | | −3.53 | −7.30 | −14.40 | −5.64 | −6.50 |
| | | average hue a* of ultrafine fiber | | 2.67 | 11.24 | 40.63 | 33.01 | 47.38 |
| | color fastness | washing fastness (specification: class) | color change (class 4) | 4 | 4-5 | 4-5 | 4-5 | 4-5 |
| | | | staining (class 3) | 4 | 4 | 4 | 4 | 4 |
| | | | fading (class 2-3) | 3 | 3 | 3 | 3 | 3 |
| | | rubbing fastness (specification: class) | dry (class 4) | 4 | 4 | 4 | 4 | 4 |
| | | | wet (class 3) | 3-4 | 4 | 4 | 4 | 4 |
| | | light fastness (specification: class) | color change (class 3) | 4 | 4 | 4 | 4 | 4 |

Comparative Example 1

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<Dyeing>

The artificial leather gray fabric prepared in the above step was dyed using a jet dyeing machine. The dyeing conditions used were as described below.

Disperse dye: Sumikaron (registered trademark) Red E-FBL (manufactured by Sumitomo Chemical Co., Ltd.): 10% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 125° C. for 60 minutes

<Reduction Cleaning>

Caustic soda (48° Be (Baume scale)): 3.6 g/liter

Hydrosulfite: 3.6 g/liter

Sandet (registered trademark) G-29 (manufactured by Sanyo Chemical Industries Ltd.): 1.2 g/liter Bath ratio: 1:20

Treatment temperature and time: 80° C. for 20 minutes

Subsequently, washing in hot water and normal temperature water was performed thoroughly and then widening and dehydration were conducted, followed by heat setting treatment for finishing at a temperature of 120° C. Because of the omission of the second dying step, the polymeric elastomer substantially failed to be colored, resulting in color unevenness on the fabric surface and color difference between the polyester ultrafine fibers and the polymeric elastomer. In addition, the lightness difference ΔL* between the polyester ultrafine fibers and the polymeric elastomer did not meet the requirements for the present invention. Results are given in Table 3.

Comparative Example 2

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<Dyeing>

The artificial leather gray fabric prepared in the above step was dyed using a jet dyeing machine. The dyeing conditions used were as described below.

Disperse dye: Sumikaron (registered trademark) Blue E-FBL (manufactured by Sumitomo Chemical Co., Ltd.): 15% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 125° C. for 60 minutes

<Reduction Cleaning>

Caustic soda (48° Be (Baume scale)): 3.6 g/liter

Hydrosulfite: 3.6 g/liter

Sandet (registered trademark) G-29 (manufactured by Sanyo Chemical Industries Ltd.): 1.2 g/liter Bath ratio: 1:20

Treatment temperature and time: 80° C. for 20 minutes

Subsequently, washing in hot water and normal temperature water was performed thoroughly and then widening and dehydration were conducted, followed by heat setting treatment for finishing at a temperature of 120° C. Because of the omission of the second dying step, the polymeric elastomer substantially failed to be colored, resulting in color unevenness on the fabric surface and color difference between the polyester ultrafine fibers and the polymeric elastomer. In addition, the lightness difference ΔL* between the polyester ultrafine fibers and the polymeric elastomer did not meet the requirements for the present invention. Results are given in Table 3.

Comparative Example 3

<Raw Stock>

As described in Example 1, raw stock of sea-island type composite fiber was obtained.

<Nonwoven Fabric>

As described in Example 1, a nonwoven fabric formed of ultrafine fiber-generating type fibers was obtained.

<Artificial Leather>

As described in Example 1, an artificial leather gray fabric formed of ultrafine fibers was obtained.

<Dyeing>

The artificial leather gray fabric prepared in the above step was dyed using a jet dyeing machine. The dyeing conditions used were as described below.

Disperse dye: Sumikaron (registered trademark) Yellow SE-RPD (manufactured by Sumitomo Chemical Co., Ltd.): 5% owf Acetic acid (90%): 1 g/liter Sodium acetate: 0.15 g/liter Sumipon (registered trademark) TF (manufactured by Sumitomo Chemical Co., Ltd.): 1.0 g/liter Bath ratio: 1:20

Dyeing temperature and time: 125° C. for 45 minutes

Subsequently, washing in hot water and normal temperature water was performed thoroughly and then widening and dehydration were conducted, followed by heat setting treatment for finishing at a temperature of 120° C. Because of the omission of the second dying step, the polymeric elastomer substantially failed to be colored, resulting in color unevenness on the fabric surface and color difference between the polyester ultrafine fibers and the polymeric elastomer. In addition, the lightness difference ΔL* between the polyester ultrafine fibers and the polymeric elastomer did not meet the requirements for the present invention. Results are given in Table 3.

TABLE 3

| | | | | Comparative example 1 | Comparative example 2 | Comparative example 3 |
|---|---|---|---|---|---|---|
| Components of artificial leather | | ultrafine fiber | | polyester fiber | polyester fiber | polyester fiber |
| | | polymeric elastomer | | polyurethane resin | polyurethane resin | polyurethane resin |
| Dyeing conditions | 1st dying step | dye type | | disperse dye | disperse dye | disperse dye |
| | | Color | | red | blue | yellow |
| | | dye concentration | | 10% owf | 15% owf | 5% owf |
| | | washing conditions (hot water, reduction cleaning, fixation) | | reduction cleaning | reduction cleaning | hot water |
| | 2nd dying step | dye type | | — | — | — |
| | | proportion of dye quantity relative to 1st dying step (actual dye concentration) | | — | — | — |
| | | dyeing temperature (° C.) | | — | — | — |
| Evaluation results | surface quality | sensory evaluation (color continuity between ultrafine fiber and polymeric elastomer) | | x | x | Δ |
| | | average lightness L* of ultrafine fiber | | 36.04 | 18.06 | 74.00 |
| | | average lightness L* of polyurethane resin | | 57.53 | 46.83 | 90.43 |
| | | lightness difference ΔL* | | −21.49 | −28.77 | −16.43 |
| | | average hue a* of ultrafine fiber | | 39.75 | 5.64 | 3.93 |
| | color fastness | washing fastness (specification: class) | color change (class 4) | 4-5 | 4 | 4-5 |
| | | | staining (class 3) | 4 | 4 | 4-5 |
| | | | fading (class 2-3) | 3 | 3 | 3-4 |
| | | rubbing fastness (specification: class) | dry (class 4) | 4 | 4 | 4-5 |
| | | | wet (class 3) | 4 | 3-4 | 4 |
| | | light fastness (specification: class) | color change (class 3) | 4 | 4 | 4 |

The invention claimed is:

1. A production method for dyed artificial leather comprising a first dying step in which artificial leather constituted mainly of a fibrous base containing ultrafine fibers of a material selected from the group consisting of polyester based fibers with a filament fineness of 2 decitex or less and a polymeric elastomer is dyed using a dye, wherein the dye is selected from the group consisting of disperse dyes, and a subsequent second dyeing step performed at a dye concentration that is 0.1% to 30% of the dye concentration (owf) in the first dyeing step, wherein the first dyeing step is performed at a dyeing temperature of 90° C. to 140° C. and the second dyeing step is performed at a dyeing temperature of 60° C. to 90° C.; the dyeing temperature in the second dyeing step is lower than the dyeing temperature in the first dyeing step; and the dye used in the second dyeing step is the same as that used in the first dyeing step.

2. A production method for artificial leather as claimed in claim 1, wherein the polymeric elastomer contains polyurethane.

3. A production method for dyed artificial leather as claimed in claim 1, wherein a washing and fixation treatment performed after the first dyeing step and the second dyeing step is realized by treatment selected from the group consisting of hot water washing treatment, reduction cleaning treatment, and dye fixation treatment.

4. A production method for dyed artificial leather as claimed in claim 1, wherein the lightness difference ΔL* between the ultrafine fibers and the polymeric elastomer represented by the following equation meets the requirement of $-16 \leq \Delta L^* \leq 5$:

$$\Delta L^* = (\text{average lightness } L^* \text{ of ultrafine fibers}) - (\text{average lightness } L^* \text{ of polymeric elastomer}).$$

5. A production method for dyed artificial leather as claimed in claim 4, wherein the polymeric elastomer contains polyurethane.

* * * * *